US008517477B2

(12) United States Patent
Dickey et al.

(10) Patent No.: US 8,517,477 B2
(45) Date of Patent: Aug. 27, 2013

(54) DOOR HOLD OPEN MECHANISM FOR A MERCHANDISER

(75) Inventors: David W. Dickey, Saint Peters, MO (US); Paul D. Fogarty, Saint Peter, MO (US); Garrick N. McFarland, Granite City, IL (US); Denise Slatton, Saint Charles, MO (US); Raymond P. Twohy, Saint Peters, MO (US)

(73) Assignee: Hussmann Corporation, Bridgeton, MO (US)

( * ) Notice: Subject to any disclaimer, the term of this patent is extended or adjusted under 35 U.S.C. 154(b) by 469 days.

(21) Appl. No.: 12/777,077

(22) Filed: May 10, 2010

(65) Prior Publication Data

US 2011/0273065 A1 Nov. 10, 2011

(51) Int. Cl.
*A47F 3/00* (2006.01)
*E05D 5/02* (2006.01)

(52) U.S. Cl.
USPC ..... 312/138.1; 16/252

(58) Field of Classification Search
USPC ..... 312/116, 138.1, 139, 405, 326, 329; 16/252, 331, 332, 335; 49/394
See application file for complete search history.

(56) References Cited

U.S. PATENT DOCUMENTS

| | | | | |
|---|---|---|---|---|
| 935,611 | A * | 9/1909 | Perkins | 16/332 |
| 3,260,545 | A | 7/1966 | Check | |
| 3,691,788 | A * | 9/1972 | Mazziotti | 464/139 |
| 4,292,707 | A | 10/1981 | Williams | |
| 4,800,624 | A | 1/1989 | Whitefoot et al. | |
| 4,948,103 | A | 8/1990 | Bowden et al. | |
| 5,867,869 | A * | 2/1999 | Garrett et al. | 16/252 |
| 5,867,871 | A * | 2/1999 | Tasman | 16/335 |
| 5,906,026 | A | 5/1999 | Junttila | |
| 5,931,554 | A | 8/1999 | Koopman | |
| 6,070,294 | A * | 6/2000 | Perkins et al. | 16/252 |
| 6,145,942 | A * | 11/2000 | Borgen | 312/138.1 |
| 6,292,978 | B1 | 9/2001 | Lakoduk et al. | |
| 6,560,821 | B2 * | 5/2003 | Miller et al. | 16/252 |
| 6,708,370 | B2 * | 3/2004 | Shih et al. | 16/332 |
| 6,820,953 | B2 * | 11/2004 | Wojcik | 312/332.1 |
| 6,842,945 | B2 | 1/2005 | Hiramatsu | |
| 6,910,302 | B2 | 6/2005 | Crawford | |
| 7,017,229 | B2 | 3/2006 | Walcome | |
| 7,234,569 | B2 | 6/2007 | Salice | |
| 7,513,582 | B2 | 4/2009 | Yoon et al. | |
| 2009/0072679 | A1 * | 3/2009 | Avila et al. | 312/116 |

FOREIGN PATENT DOCUMENTS

| | | |
|---|---|---|
| GB | 2082726 | 3/1982 |

* cited by examiner

*Primary Examiner* — James O Hansen
(74) *Attorney, Agent, or Firm* — Michael Best & Friedrich LLP

(57) ABSTRACT

A merchandiser including a case defining a product display area for supporting and displaying food product. The case includes a case frame that has at least one mullion defining an opening into the product display area, a door that is positioned over the opening and pivotably coupled to the case frame for movement between a closed position and an open position, and a door hold open mechanism attached to either the mullion or the door. The other of the mullion and the door defines a channel, and the door hold open mechanism includes an engagement member that is outwardly biased from the mullion or the door to which the door hold open mechanism is attached such that the engagement member is engageable with the other of the mullion and the door within the channel to hold the door in the open position.

24 Claims, 14 Drawing Sheets

DOOR HOLD OPEN MECHANISM FOR A MERCHANDISER

BACKGROUND

The present invention relates to a merchandiser including a door hold open mechanism, and more particularly, to a merchandiser including a door hold open mechanism to hold a door of the merchandiser in an open position.

Refrigerated merchandisers generally include a case defining a product display area for supporting and displaying food products to be visible and accessible through an opening in the front of the case. Refrigerated merchandisers are generally used in retail food store applications such as grocery or convenient stores or other locations where food product is displayed in a refrigerated condition. Some refrigerated merchandisers include doors to enclose the product display area of the case and reduce the amount of cold air released into the surrounding environment. The doors are typically attached to vertically oriented mullions and include one or more glass panels, which allow a consumer to view the food products stored inside the case. The mullions support the doors and provide an area upon which door gaskets can be sealed to seal the refrigerated product display area from the surrounding ambient environment.

SUMMARY

In one construction, the invention provides a merchandiser including a case that defines a product display area for supporting and displaying food product. The case includes a case frame that has at least one mullion defining an opening into the product display area, a door that is positioned over the opening and pivotably coupled to the case frame for movement between a closed position and an open position, and a door hold open mechanism attached to either the mullion or the door. The other of the mullion and the door defines a channel, and the door hold open mechanism includes an engagement member that is outwardly biased from the mullion or the door to which the door hold open mechanism is attached such that the engagement member is engageable with the other of the mullion and the door within the channel to hold the door in the open position.

In another construction, the merchandiser includes a door hold open mechanism that is attached to either the mullion or the door. The other of the mullion and the door defines a channel. The door hold open mechanism includes an engagement member that is outwardly biased from the mullion or the door to which the door hold open mechanism is attached. The engagement member is engageable with the other of the mullion and the door within the channel to hold the door in the open position, and the engagement member is disengageable from the other of the mullion and the door in response to a predetermined force applied to the door toward the closed position.

In yet another construction, the merchandiser includes a door that has a hinge defining a channel at least partially along the length of the door, and a door hold open mechanism that has a housing attached to the mullion of the merchandiser. The door hold open mechanism also has a spring-loaded elongated pin that is outwardly biased from the housing and that is engageable with the door within the channel to hold the door in the open position.

Aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
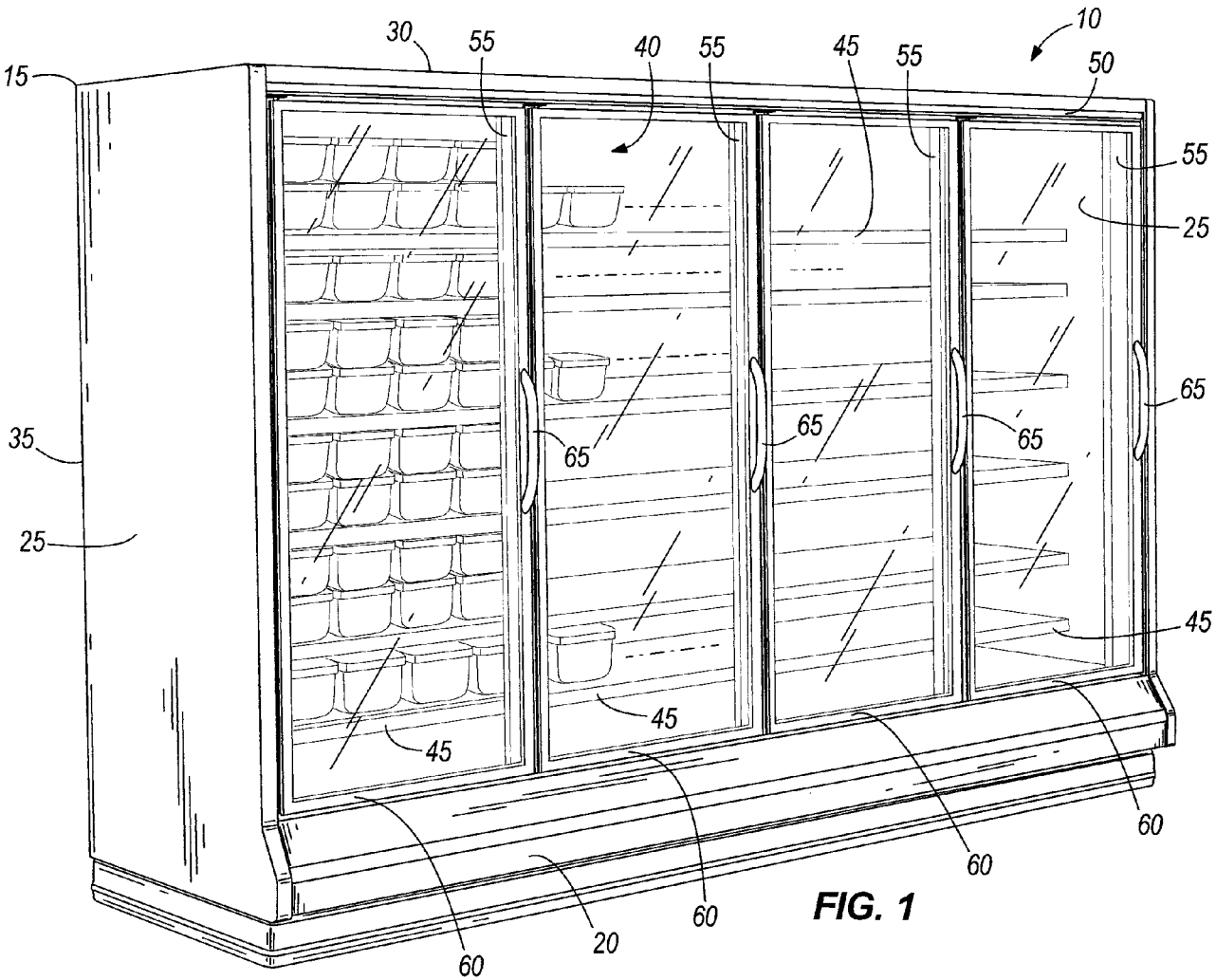
FIG. 1 is a perspective view of an exemplary merchandiser including doors in the closed position.
Figure 2:
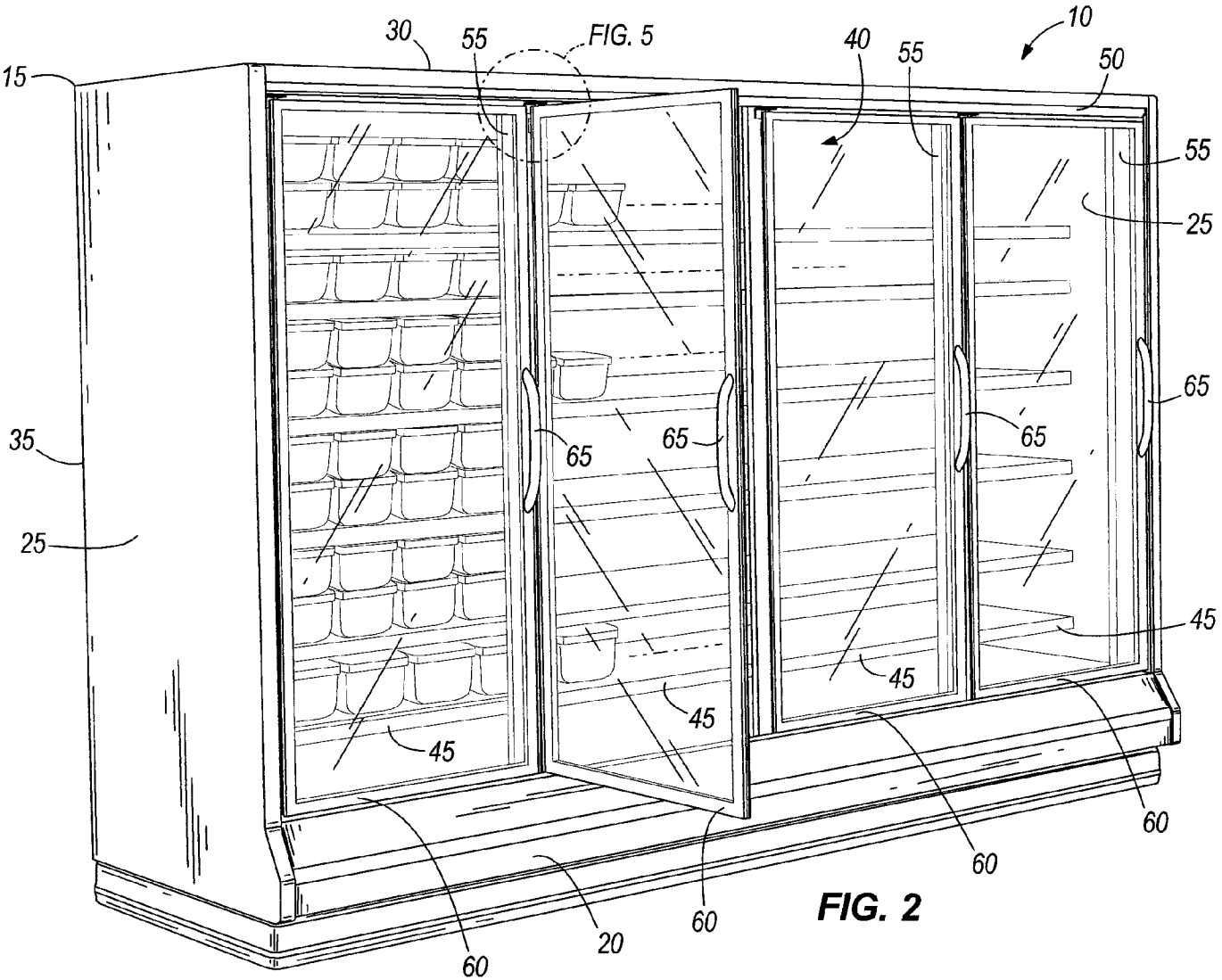
FIG. 2 is another perspective view of the merchandiser of FIG. 1, including a door in an open position.

FIGS. 1 and 2 show a merchandiser 10 for displaying food product (e.g., frozen food, fresh food, beverages, etc.) available to consumers in a retail setting (e.g., a supermarket or grocery store). The merchandiser 10 includes a case 15 that has a base 20, side walls 25, a case top or canopy 30, and a rear wall 35. At least a portion of a refrigeration system (not shown) can be located within the case 15 to refrigerate the food product. In other constructions, a heating system can be located within the case 15 to heat the food product. The area partially enclosed by the base 20, the side walls 25, the case top 30, and the rear wall 35 defines a product display area 40. The food product is supported on shelves 45 within the product display area 40.

The case 15 includes a case frame 50 adjacent a front of the merchandiser 10. The case frame 50 includes vertical mullions 55 that define openings in the case 15, and doors 60 positioned over the openings. The doors 60 are configured to allow access to food product stored in the product display area 40. The mullions 55 are spaced horizontally along the case 15 to provide structural support for the case 15. Each mullion 55 is defined by a structural member that can be formed from a non-metallic or metallic material.

Figure 3:
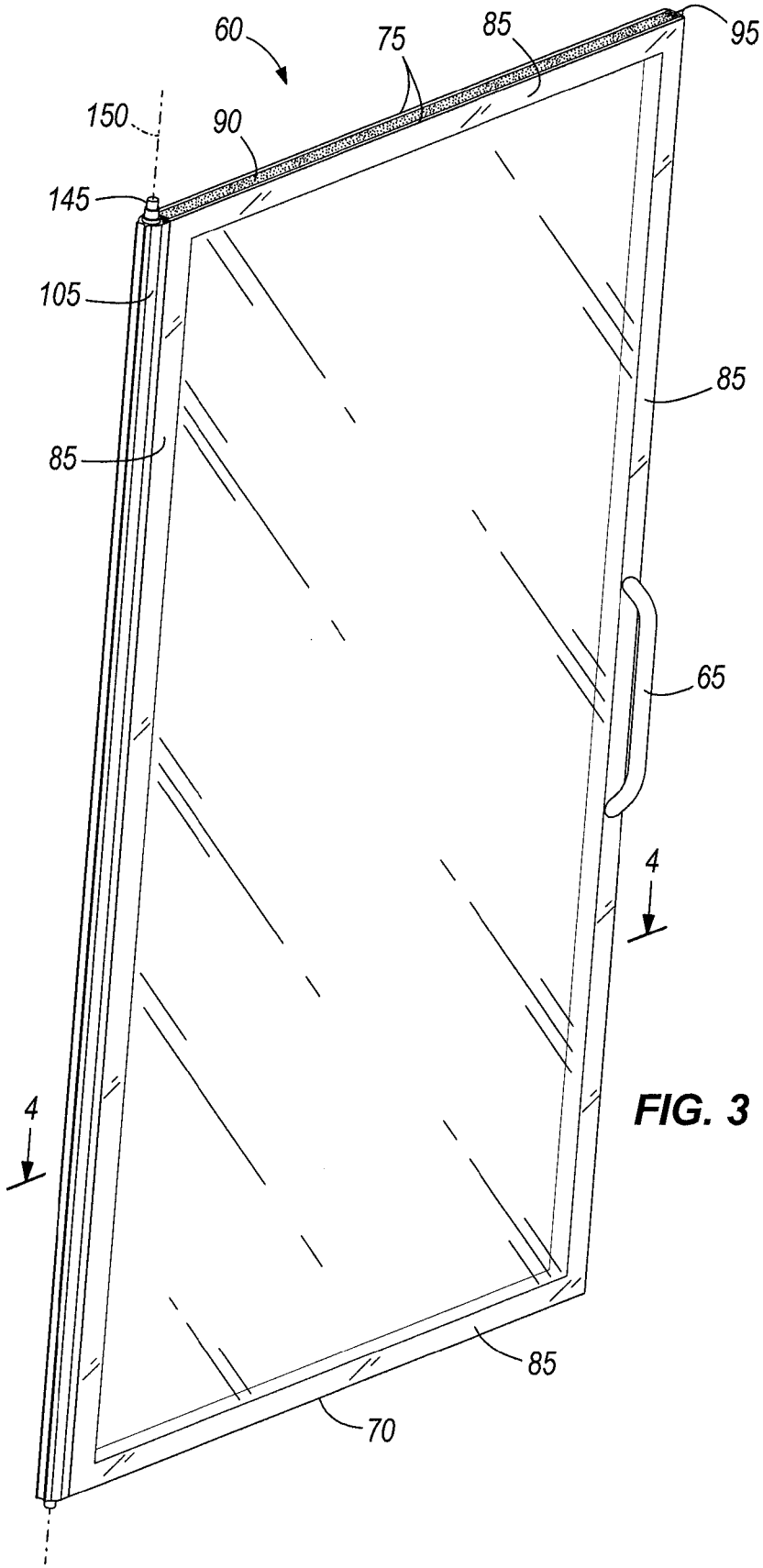
FIG. 3 is a perspective view of one door of the merchandiser of FIG. 1.

FIG. 1 shows the doors 60 in the closed position. FIG. 2 shows one door 60 in an open position (e.g., full open position) and the remaining doors 60 in the closed position. As shown in FIGS. 1-3, a handle 65 is positioned along a first longitudinal edge of each door 60 to move the door 60 between the open position and the closed position.

Figure 4:
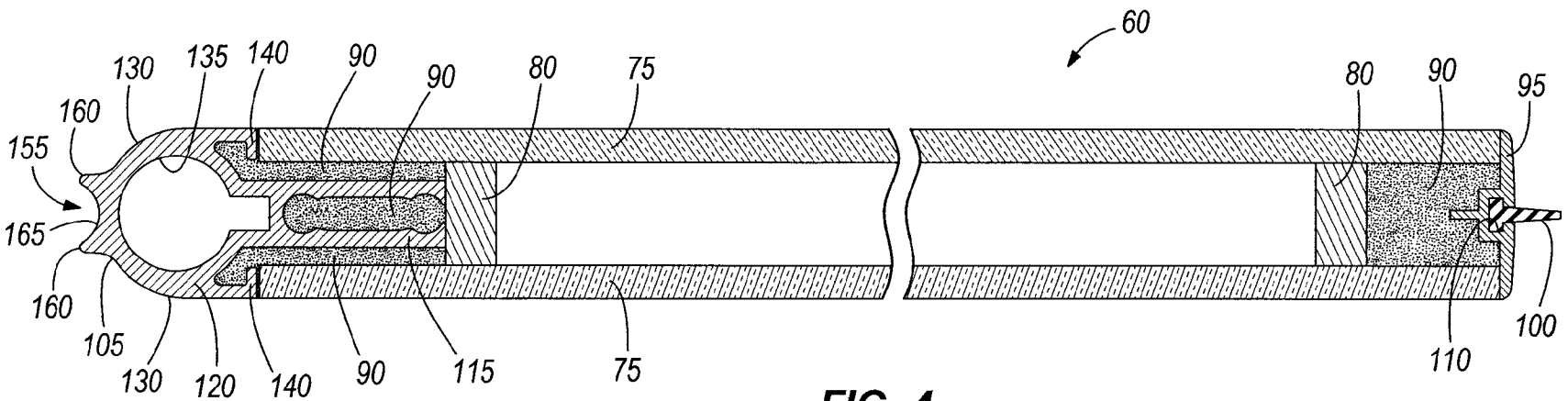
FIG. 4 is a section view of the door of FIG. 3 taken along line 4-4.

As illustrated in FIGS. 3 and 4 each door 60 is a frameless door including a glass assembly 70 to allow viewing of the food product from outside the case 15. In other constructions, the door 60 may include a door frame for supporting the glass assembly 70.

Figure 5:
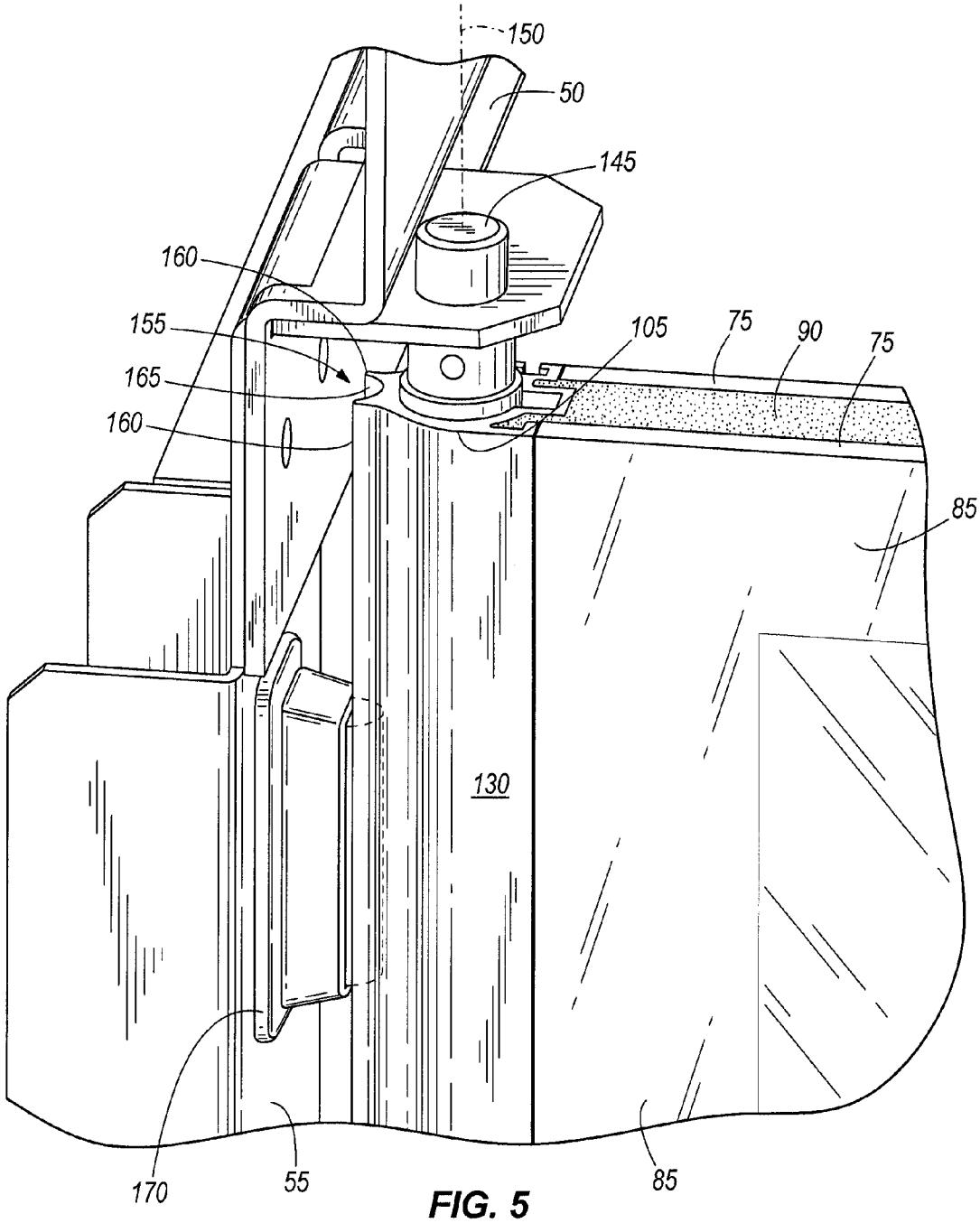
FIG. 5 is a perspective view of a portion of the merchandiser and the open door of FIG. 2, including a door hold open mechanism attached to the merchandiser.

The glass assembly 70 can be formed from glass or from other materials that are substantially translucent (e.g., acrylic, etc.). As illustrated in FIG. 4, the glass assembly 70 includes two glass panes 75 and a spacer 80 that is positioned between the glass panes 75. FIG. 5 shows that the glass panes 75 include edge portions 85 each having a ceramic silk screen to limit visibility through the edges of the glass panes 75. In other constructions, the glass assembly 70 may include more or fewer than two glass panes 75. Also, the glass panes 75 may include low-emissivity glass and/or coatings to limit undesirable light or heat transfer through the glass assembly 70 and to limit condensation.

FIG. 4 shows the spacer 80 is recessed inward a small distance from the edges of the glass panes 75. The spacer 80 extends around the door along all four sides of the glass panes 75, and sealant 90 is placed between the spacer and the edges of the glass panes 75. The spacer 80 separates the glass panes 75 from each other to create a void that is filled with dry air or an inert gas (e.g., Argon, etc.) that limits heat transfer between the product display area 40 and the ambient environment surrounding the merchandiser 10. In some constructions, the spacer 80 can include a desiccant that helps dry the air trapped between the glass panes 75.

FIGS. 4 and 5 show that the door 60 also includes edge trim 95 coupled to the first longitudinal edge of the door 60 (adjacent the handle 65), a wiper 100 coupled to the edge trim 95, and a hinge 105 attached to a second longitudinal edge of the door 60 that is opposite the first longitudinal edge. The edge trim 95 is adhered to the door 60 via the sealant 90 and/or other adhesive. The wiper 100 is attached to the edge trim 95 within a channel 110.

In the illustrated construction, the hinge 105 extends along the entire vertical length of the door 60. The hinge 105 is attached to the second longitudinal edge of the door 60 via the sealant 90. Specifically, the hinge 105 extends into the sealant 90 to hold, support, and align the glass panes 75. The illustrated hinge 105 extends along the entire length of the second longitudinal edge of the door 60. In some constructions, the hinge 105 may have a length that is shorter than the length of the door 60. In other constructions, the door 60 can include two or more hinges 105 attached to the second longitudinal edge (e.g., two hinges 105 may be positioned adjacent the top and bottom of the door 60).

The hinge 105 is defined by an elongated body and includes a door attachment portion 115 and a door hinge portion 120. The door attachment portion 115 is engaged with the glass panes 75 and the sealant 90 to attach the hinge 105 to the door 60. The door attachment portion is defined by spaced apart arms to maximize surface area for attaching the hinge 105 to the glass assembly 70. The space between the arms of the door attachment portion 115 also can be used to attach a door bracket (not shown) to the door 60 via fasteners (not shown).

With reference to FIGS. 3 and 4, the door hinge portion 120 is located outward from the door attachment portion 115 along the second longitudinal edge of the door 60. The door hinge portion 120 is defined by a curved outer surface 130, and includes a pivot channel 135, alignment guides 140, and a pivot 145. The alignment guides 140 abut the glass panes 75 to align the glass panes 75 relative to each other and with the hinge 105. The pivot 145 is disposed in the pivot channel 135 and extends outward from the hinge 105 to engage the case frame 50 such that the door 60 is pivotable between the closed position and the open position about an axis 150 extending through the pivot 145.

The door hinge portion 120 also includes a hinge channel or groove 155 that extends longitudinally along the hinge 105. The illustrated hinge channel 155 is defined by symmetrically opposed ridges 160 and a curved surface 165 (e.g., semi-cylindrical surface) between the opposed ridges 160. In the illustrated construction, the hinge channel 155 extends along the entire length of the hinge 105. In other constructions, the hinge channel 155 may be shorter than the hinge 105.

As illustrated in FIG. 5, the merchandiser 10 also includes a door hold open mechanism 170 that is attached to the mullion 55 at a location adjacent the second longitudinal edge of the door 60 (i.e., adjacent the hinge 105). Generally, one door hold open mechanism 170 is attached to each mullion 55 of the merchandiser 10. The door hold open mechanism 170 is positioned on the mullion 55 adjacent the door 60 so that the door hold open mechanism 170 is engageable with the corresponding hinge channel 155 to hold the door 60 in the open position. In some constructions, more than one door hold open mechanism 170 may be attached to each mullion 55 and vertically spaced apart from each other to respectively engage the hinge channel 155. In other constructions, the door hold open mechanism 170 can be attached to the door 60. In these constructions, the channel 155 can be located on the mullion 55.

The door hold open mechanism 170 is attached to the mullion 55 by any suitable attachment means (e.g., adhesive, fasteners, etc.). FIGS. 5-12 show that the door hold open mechanism 170 includes a housing 175, a cover 180, a plunger or housing support 185, springs 190, and an engagement member or pin 195. The housing 175 includes a first portion 200, a second portion 205 extending from the first portion 200, and a wall 210 that defines a cavity 215. The portion of the cavity 215 defined by the wall 210 within the second portion 205 is narrower than the portion of the cavity 215 defined by the wall 210 within the first portion 200 such that the wall 210 defines stop portions 245. The cavity 215 extends completely through the housing 175 for accommodating the cover 180, the plunger 185, the springs 190, and the pin 195.

The first portion 200 is slightly tapered and includes bendable tabs 225 that partially enclose the cavity 215 to hold the cover 180, the plunger 185, the springs 190, and the pin 195 within the housing 175. The second portion 205 includes a flange 230 that surrounds the housing 175 to engage and secure the housing 175 to the mullion 55, and pin engagement portions 235 extending along opposed sides of the cavity 215 that capture or hold the pin 195 within the housing 175. When the housing 175 is attached to the mullion 55, the first portion 200 is recessed in and engaged with the mullion 55, and the second portion 205 extends outward from the mullion 55.

FIGS. 6, 7, and 10-12 show the cover 180 is disposed in the cavity 215 and extends along the length of the housing 175. The cover 180 includes countersinks 240 for individually supporting the springs 190. Generally, the quantity of countersinks 240 corresponds to the quantity of springs 190 in the door hold open mechanism 170. When bent, the tabs 225 partially extend over and engage the cover 180 to hold the cover 180 in the cavity 215.

Figure 10:
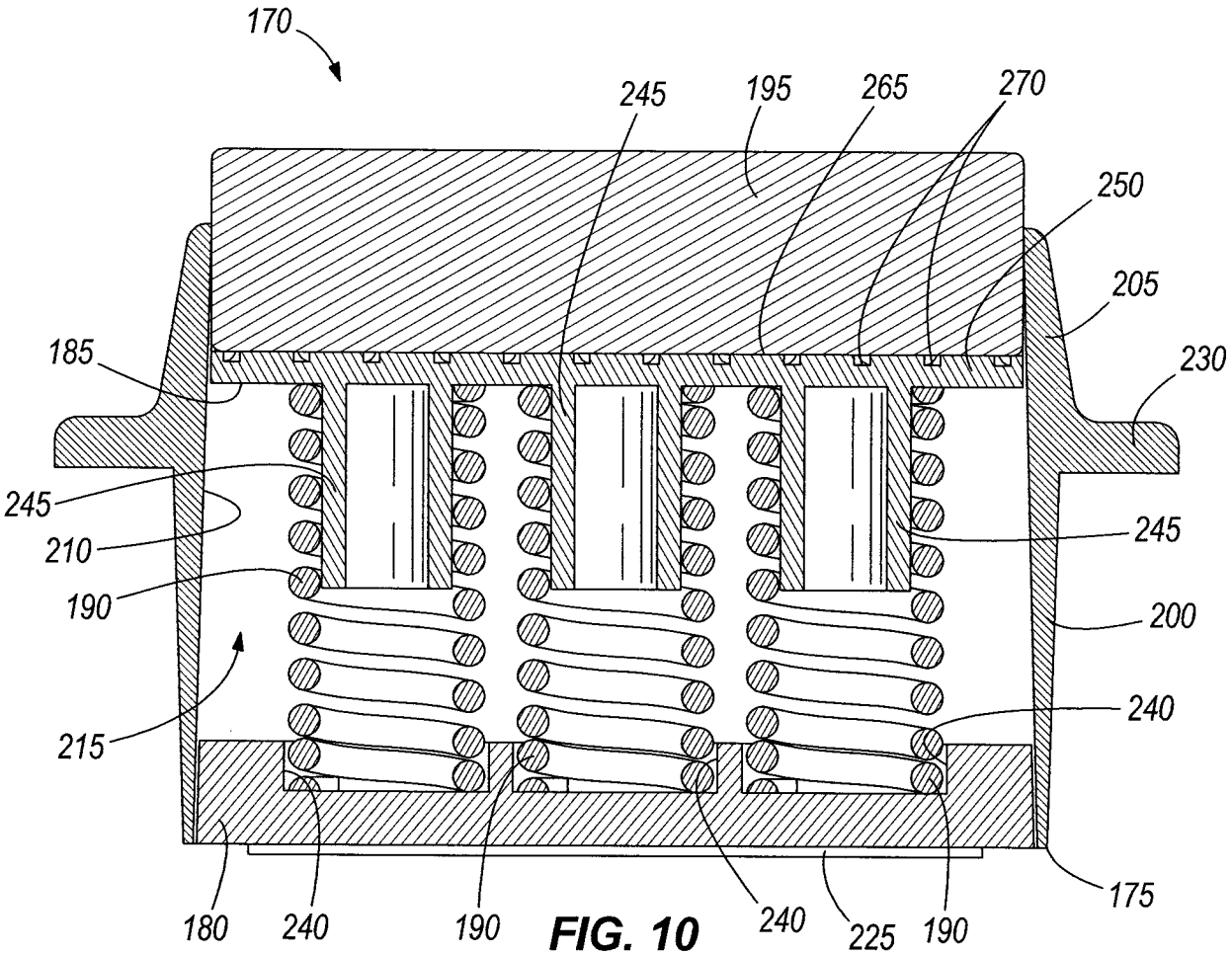
FIG. 10 is a section view of the door hold open mechanism of FIG. 9 taken along line 10-10 showing a housing, a plunger, springs, and a pin.
Figure 12:
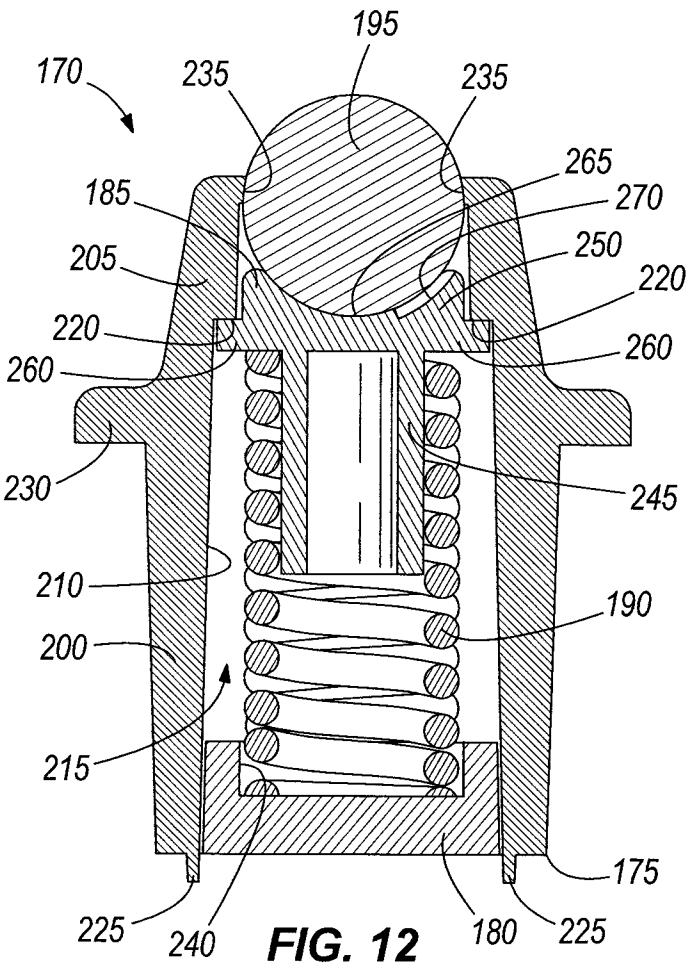
FIG. 12 is a section view of the door hold open mechanism showing the housing tabs in an open position.
Figure 11:
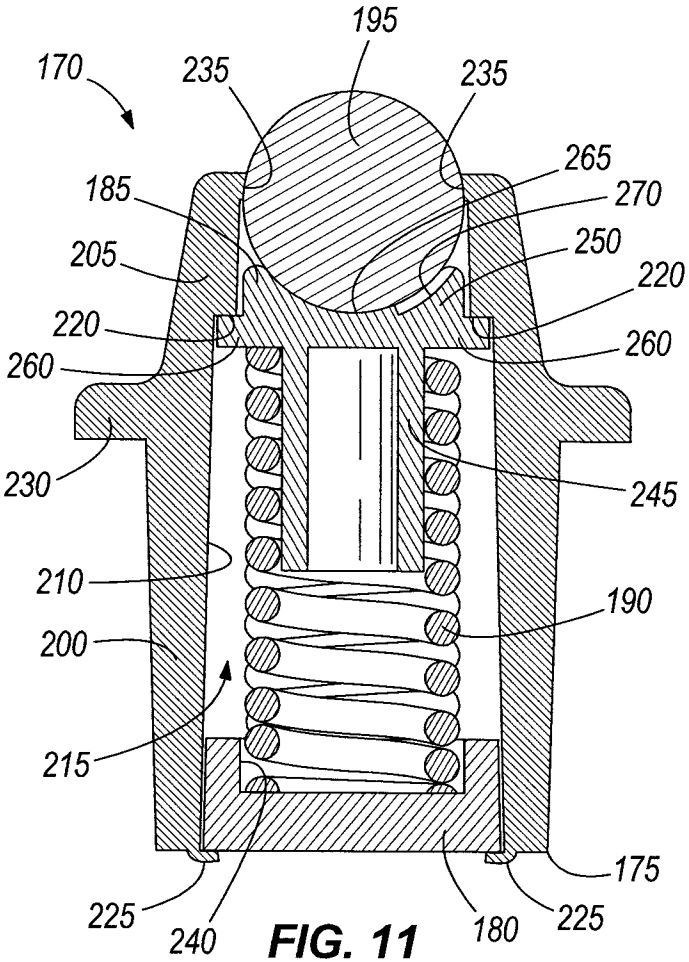
FIG. 11 is a section view of the door hold open mechanism of FIG. 8 taken along line 11-11 showing housing tabs in a closed position.
Figure 13:
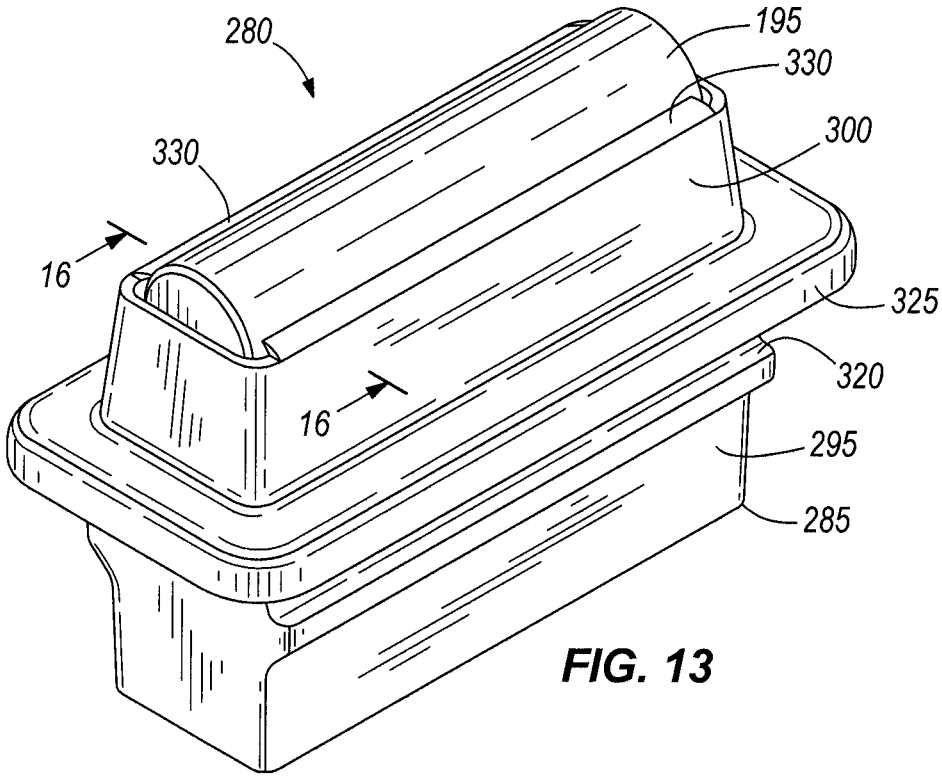
FIG. 13 is a perspective view of another door hold open mechanism for the merchandiser of FIG. 1.
Figure 14:
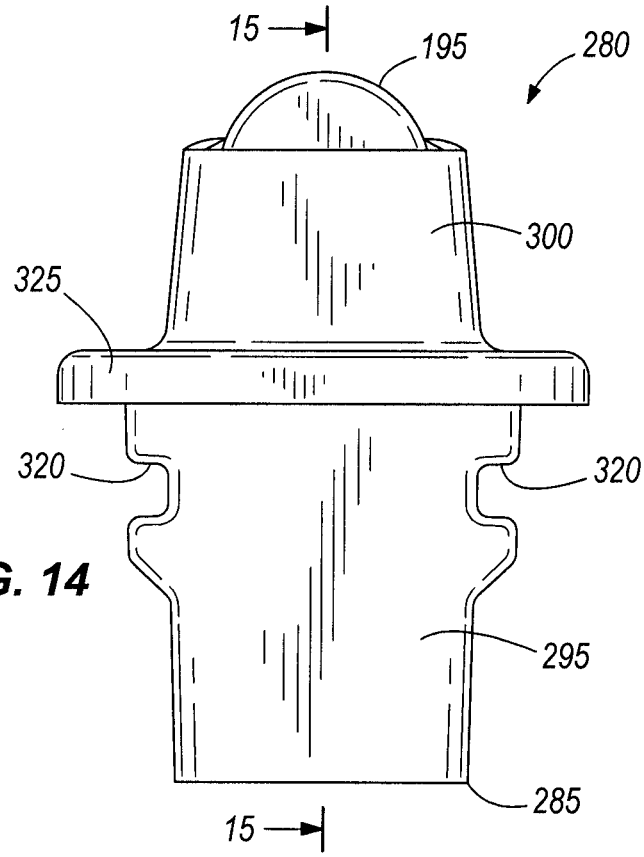
FIG. 14 is a side view of the door hold open mechanism of FIG. 13.
Figure 15:
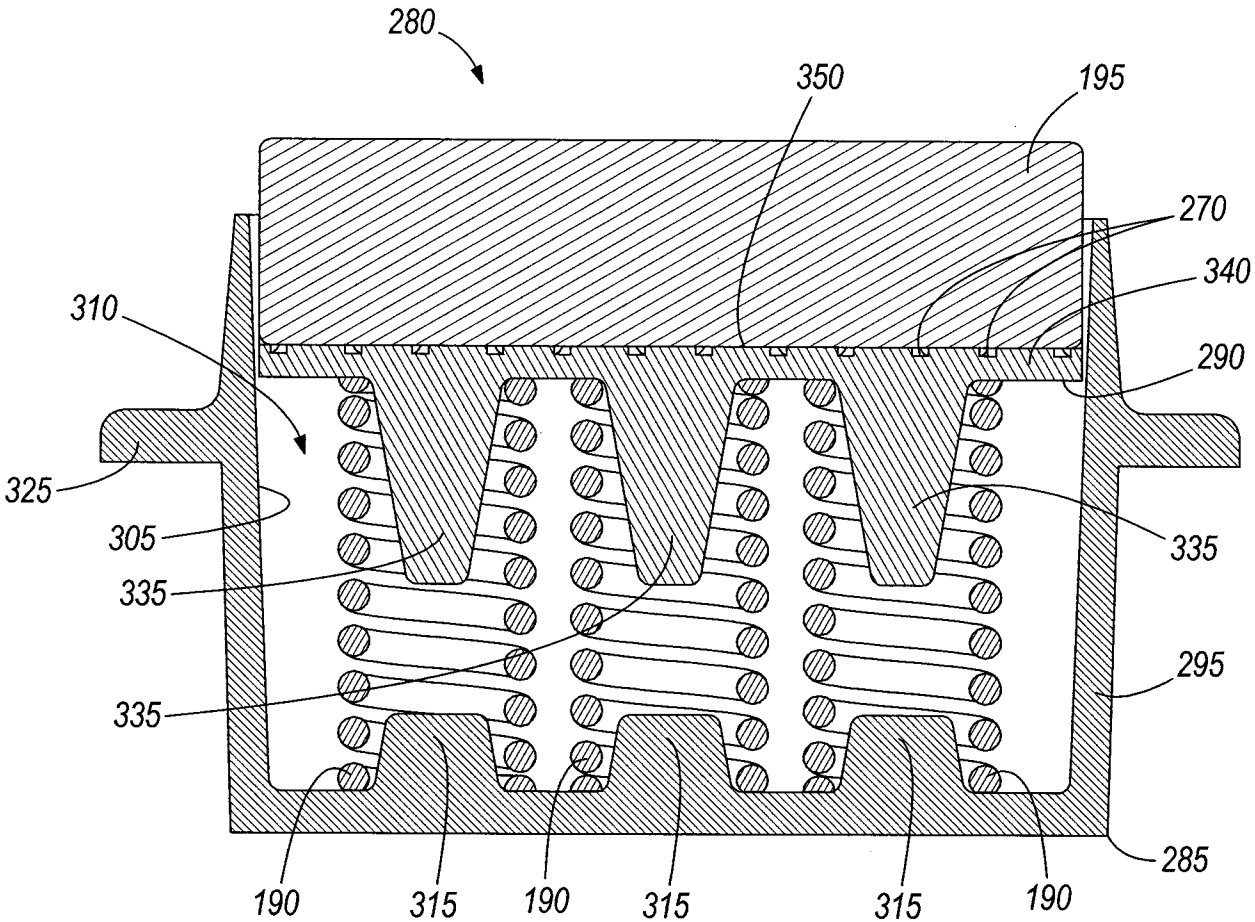
FIG. 15 is a section view of the door hold open mechanism of FIG. 14 taken along line 15-15 showing a housing, a plunger, springs, and a pin.
Figure 17:
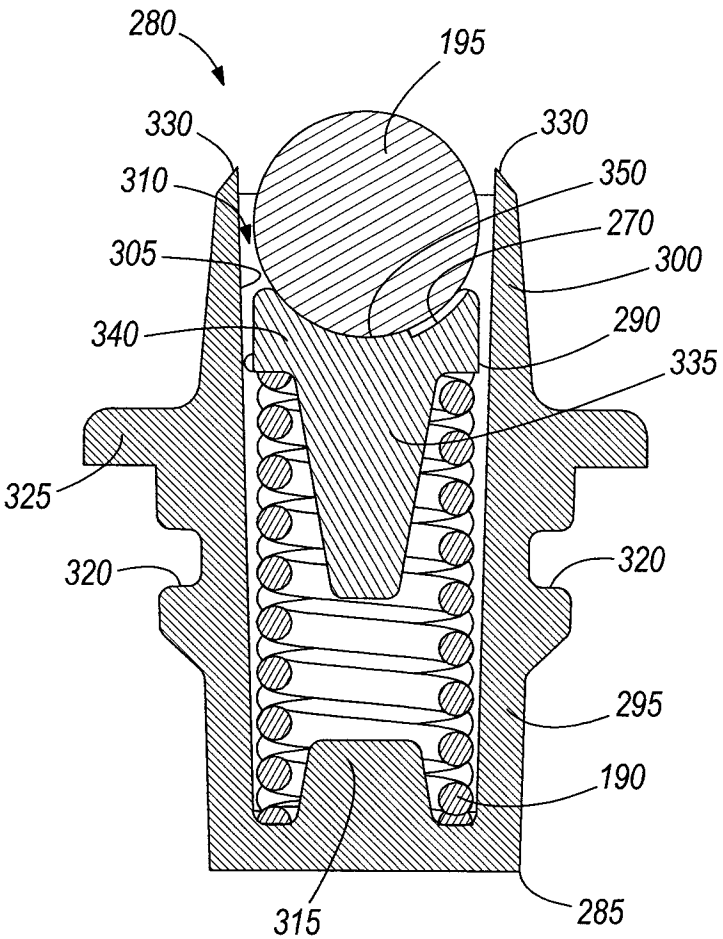
FIG. 17 is a section view of the door hold open mechanism of FIG. 13 including the housing tabs in an open position.
Figure 16:
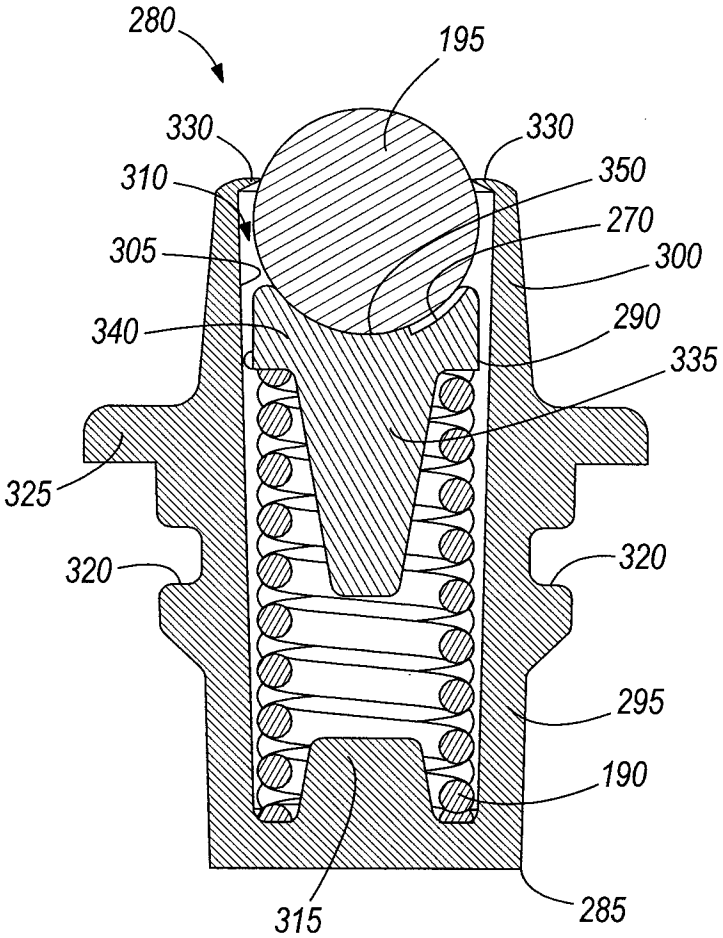
FIG. 16 is a section view of the door hold open mechanism of FIG. 13 taken along line 16-16 and including housing tabs in a closed position.

FIGS. 10-12 show the plunger 185 is disposed within the housing 175 and engages the stop portions 245 within the cavity 215 to limit movement of the plunger 185 in a first direction outward from the housing 175 (i.e. upward as viewed in FIGS. 10-12). The plunger 185 is defined by an elongated body, and includes legs or spring engagement portions 245 and a pin support 250 connected to the spring engagement portions 245. The spring engagement portions 245 are substantially cylindrically-shaped and are insertable into or recessed in the springs 190. The illustrated spring engagement portions 245 are hollow, although solid spring engagement portions are also possible.

Figure 18:
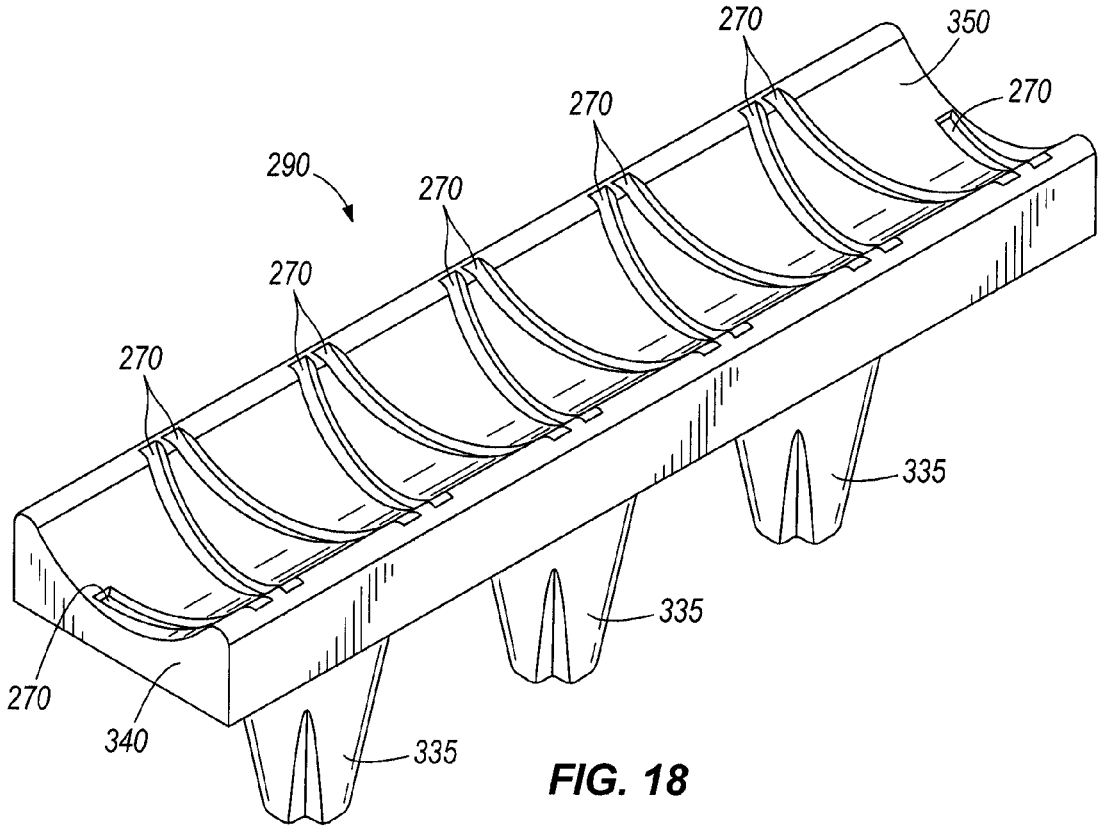
FIG. 18 is a perspective view of the plunger of FIG. 15.
Figure 19:
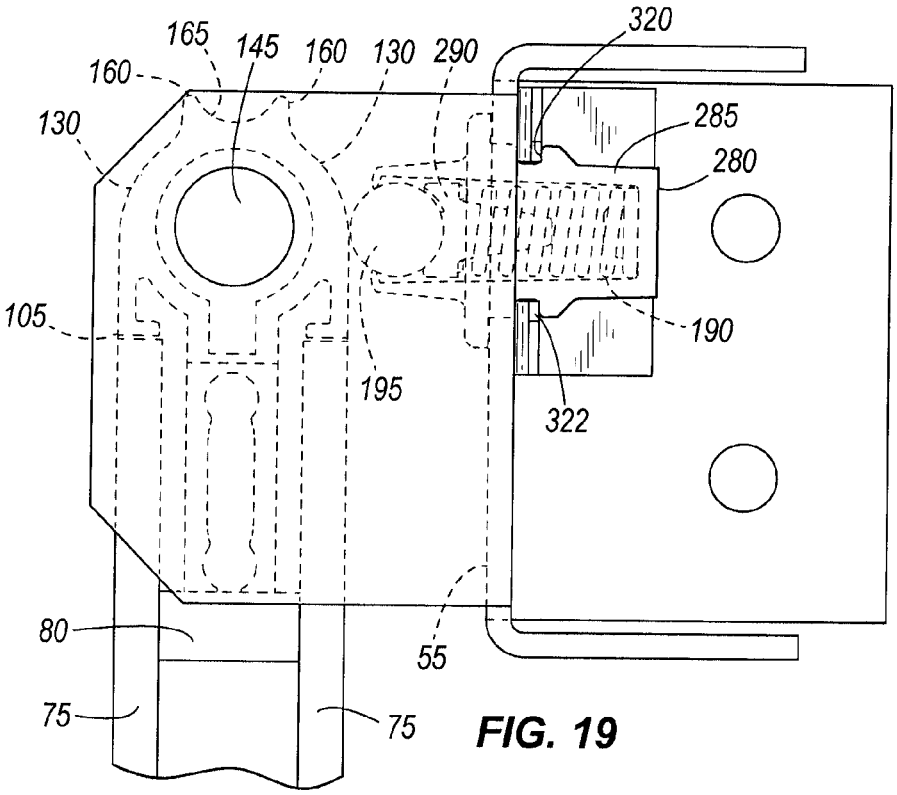
FIG. 19 is a top view of a portion of the merchandiser and the closed door of FIG. 1 including the door hold open mechanism of FIG. 13.

FIGS. 10-12 show that the pin support 250 defines a platform for supporting the pin 195 and includes extensions 260 defined along elongated edges of the plunger 185. The pin support 250 has a substantially semi-cylindrical surface 265 (i.e., a substantially semi-circular surface in cross-section) that supports the pin 195, and grooves 270 (see FIG. 18) that crisscrosses the surface 265 along the length of the pin support 250 to reduce friction between the pin 195 and the pin support 250. The extensions 260 abut the stop portions 245 for limiting movement of the plunger 185 in the first direction within the housing 175.

The springs 190 disposed in the housing 175 and are engaged with the cover 180 within the countersinks 240 on one side, and are engaged with the plunger 185 via the spring engagement portions 210 on the other side. The countersinks 240 couple and align the springs 190 with the plunger 185 in the housing 175. The springs 190 have predetermined spring rates so that the springs 190 act on the cover 180 to bias the plunger 185 and the pin 195 in the first direction outward from the housing 175. The springs 190 are compressible in a second direction inward within the housing 175 in response to a force on the pin 195 and the plunger 185. In the illustrated construction, the door hold open mechanism 170 includes three springs 190. In some constructions, fewer or more than three springs 190 can be used to bias the plunger 185 and the pin 195.

FIGS. 6-12 show that the pin 195 is an elongated roller defined by a cylindrical body that is disposed in the housing 175. The pin 195 is nested in or supported by the plunger 185 such that a portion of the pin 195 is partially exposed relative to the housing 175. The pin 195 is rotatable on the pin support 250, and the pin engagement portions 235 encapsulate the pin 195 to limit translational movement of the pin 195 relative to the housing 175. The pin engagement portions 235 also hold the pin 195 partly within the housing 175 against the bias of the springs 190.

Figure 6:
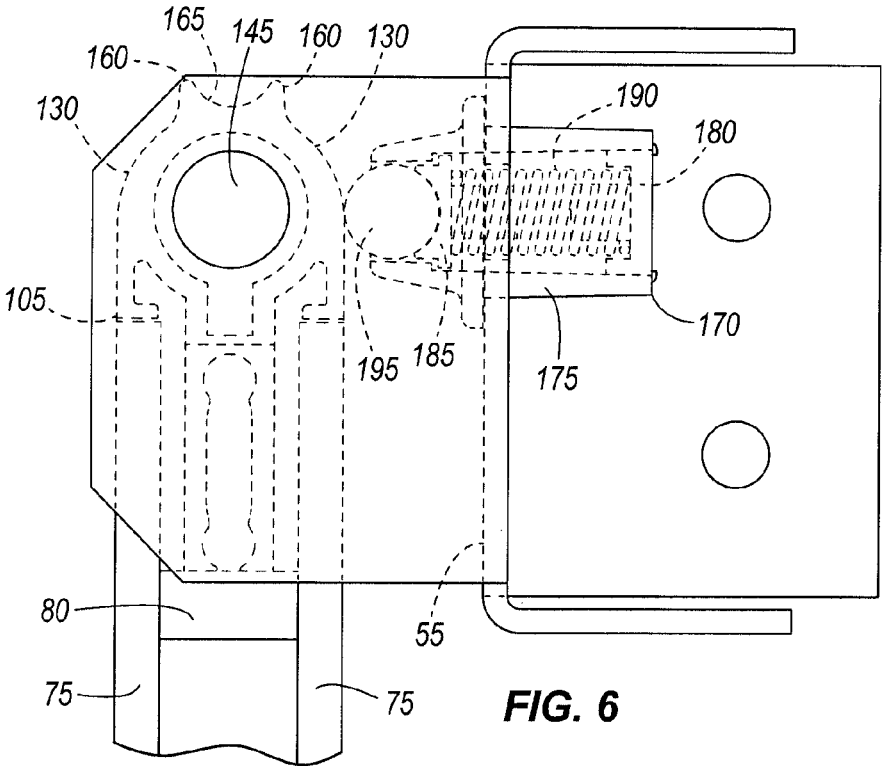
FIG. 6 is a top view of a portion of the merchandiser and a closed door of FIG. 1.
Figure 7:
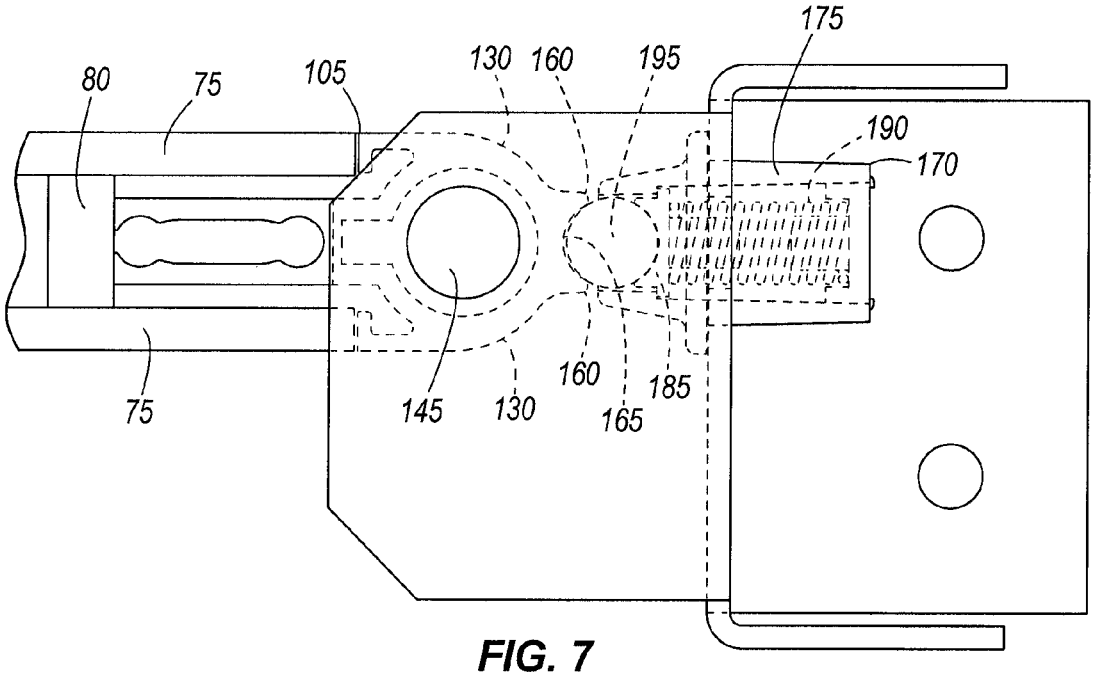
FIG. 7 is a top view of a portion of the merchandiser and the open door of FIG. 2.
Figure 8:
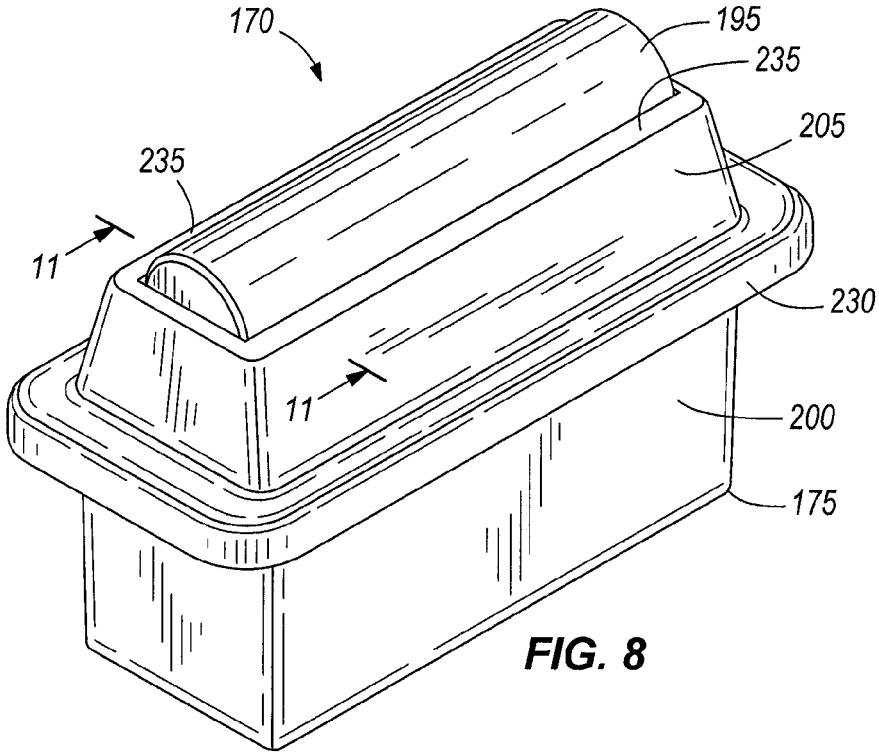
FIG. 8 is a perspective view of the door hold open mechanism of FIG. 3.
Figure 9:
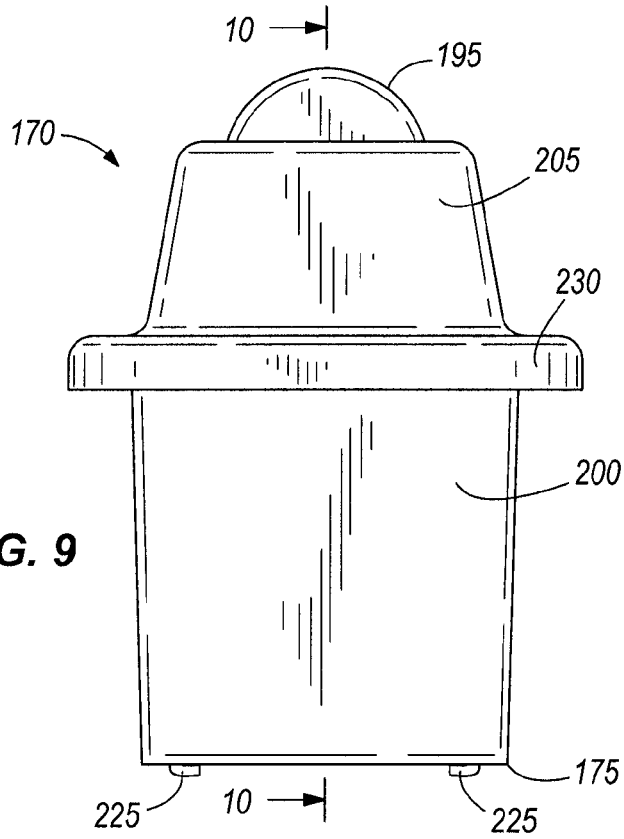
FIG. 9 is a side view of the door hold open mechanism of FIG. 8.

FIG. 6 shows that the pin 195 is engaged with or contacts the outer surface 130 of the hinge 105 when the door 60 is in the closed position. In other constructions, the door hold open mechanism 170 may be attached to the mullion 55 so that the pin 195 is spaced apart a small distance from the hinge 105 when the door 60 is in the closed position. FIGS. 5 and 7 show that the pin 195 is engaged with the hinge 105 within the hinge channel 155 when the door 60 is in a 90 degree open position to hold the door 60 in that position. When the pin 195 is engaged with the hinge 105, the pin 195 and the channel 105 define a ball-and-socket fit. In other constructions, the open position may include angular openings that are less or more than 90 degrees.

FIGS. 13-20 show another construction of a door hold open mechanism 280 for the merchandiser 10. Except as described below, the door hold open mechanism 280 is the same as the door hold open mechanism 170 described with regard to FIGS. 5-12, and common elements have been given the same reference numerals.

The door hold open mechanism 280 includes the springs 190, the pin 195, a housing 285, and a plunger or housing support 290. FIGS. 13-17, 19, and 20 show that the housing 285 includes a first portion 295, a second portion 300 extending from the first portion 295, and a wall 305 that defines a cavity 310. As illustrated, the cavity 310 extends partially through the housing 285 for accommodating the pin 195, the springs 190, and the plunger 290, and narrows slightly from the second portion 300 toward the first portion 295. In other constructions, the cavity 310 may have substantially the same width in the first and second portions 255, 260. Spring supports or protrusions 315 extend inward from the wall 305 adjacent the enclosed side of the cavity 310 to support and align the springs 190 within the housing 285.

The first portion 295 includes clip recesses 320 located on the exterior side of the wall 305 for receiving a "C"-clip 322 (see FIGS. 19 and 20) for securing the door hold open mechanism 280 to the mullion 55. The second portion 300 includes a flange 325 that is engageable with the mullion 55, and pin engagement portions or tabs 330 that are disposed on the ends of the wall 305 adjacent the opening to the cavity 310 to capture or hold the springs 190, the pin 195, and the plunger 290 within the housing 285. When the housing 285 is attached to the mullion 55, the first portion 295 is recessed in and engaged with the mullion 55, and the second portion 300 extends outward from the mullion 55.

FIGS. 15-18 show the plunger 290 is disposed within the housing 285, and is movable in the first direction due to the bias of the springs 190. The plunger 290 also is movable in the second direction in response to a force exerted on the pin 195. The plunger 290 is defined by an elongated body, and includes legs or spring engagement portions 335 and a pin support 340 connected to the spring engagement portions 335. The spring engagement portions 335 are cone-shaped and are insertable into or recessed in the springs 190. The illustrated spring engagement portions 335 are solid, although hollow spring engagement portions 335 are also possible.

The pin support 340 is wider than the diameter of the springs such that the plunger 290 is coupled to or rests on the ends of the springs. The pin support 340 defines a platform for supporting the pin 195, and includes the grooves 270 and a substantially semi-cylindrical surface 350 (i.e., a substantially semi-circular surface 310 in cross-section).

With regard to FIGS. 5-12, the door hold open mechanism 170 is a "back-loaded" hold open device that is attached to the mullion 55. The door hold open mechanism 170 is assembled by inserting the pin 195 into the housing 175, inserting the plunger 185 into the housing 175, and engaging the pin support 340 with the pin 195. The springs are then inserted into the housing 175 so that the innermost ends of the springs 190 encapsulate the spring engagement portions 245. The cover 180 is positioned in the opening to the cavity 215 adjacent the first portion 200 so that the outermost ends of the springs 190 are engaged with the countersinks 240. The tabs 225 are then bent over to hold the cover 180, the plunger 185, the springs 190, and the pin 195 at least partially within the housing 175. The housing 175 is then inserted into a corresponding opening in the mullion 55 so that the flange 230 engages or abuts the mullion 55. The tapered first portion 200 creates a press-fit for attaching the door hold open mechanism 170 to the mullion 55.

With regard to FIGS. 13-17, the door hold open mechanism 280 is a "front-loaded" device that is attached to the mullion 55 for engaging the hinge 105. The door hold open mechanism 280 is assembled by inserting the springs 190 into the housing 175 and engaging the innermost ends of the springs 190 with the spring supports 315. The plunger 290 is then inserted into the housing 285 and engaged with the springs 190 so that the spring engagement portions 335 are disposed within the springs 190. The pin 195 is inserted into the housing 285 and is engaged with the pin support 340. The tabs 330 are bent over to hold the springs 190, the pin 195, and the plunger 290 at least partially within the housing 285. In some constructions, the springs 190, the pin 195, and the plunger 290 can be simultaneously inserted into the housing 285 as a sub-assembly. The housing 285 is then inserted into the corresponding opening in the mullion 55 so that the flange 325 engages or abuts the mullion 55. The housing 285 is held in engagement with the mullion 55 by attaching the "C"-clip 322 to the housing 285 within the clip recesses 320.

In operation, the door hold open mechanism 170, 280 holds the door 60 in the open position without a user-operated (i.e., manually-operated) catch. While the illustrated door 60 is held open at approximately a 90 degree angle relative to the closed position, the open position can be any angular position of the door 60 relative to the closed position (e.g., angularly spaced 30-180 degrees relative to the closed position). In some constructions, the components of the door hold open mechanism 170, 280 can be angled relative to the mullion 55 (i.e., oriented at a non-90 degree angle) to accommodate different predetermined open positions of the door 60.

The pin engagement portions 235, 330 allow the pin 195 to extend outward from the housing 175, 285 so the pin 195 can roll relative to the housing 175, 285. When the door 60 is pivoted toward the open position, the pin 195 is biased in the first direction by the springs 190 and the plunger 185, 290, and the pin 195 rolls or rotates along the outer surface 130 of the door hinge portion 120. As the door 60 nears the open position, the ridge 160 closest to the door hold open mechanism 170, 280 pushes the pin 195 into the housing 175, 285 in the second direction against the bias of the springs 190 so that the door 60 can continue toward the open position.

Figure 20:
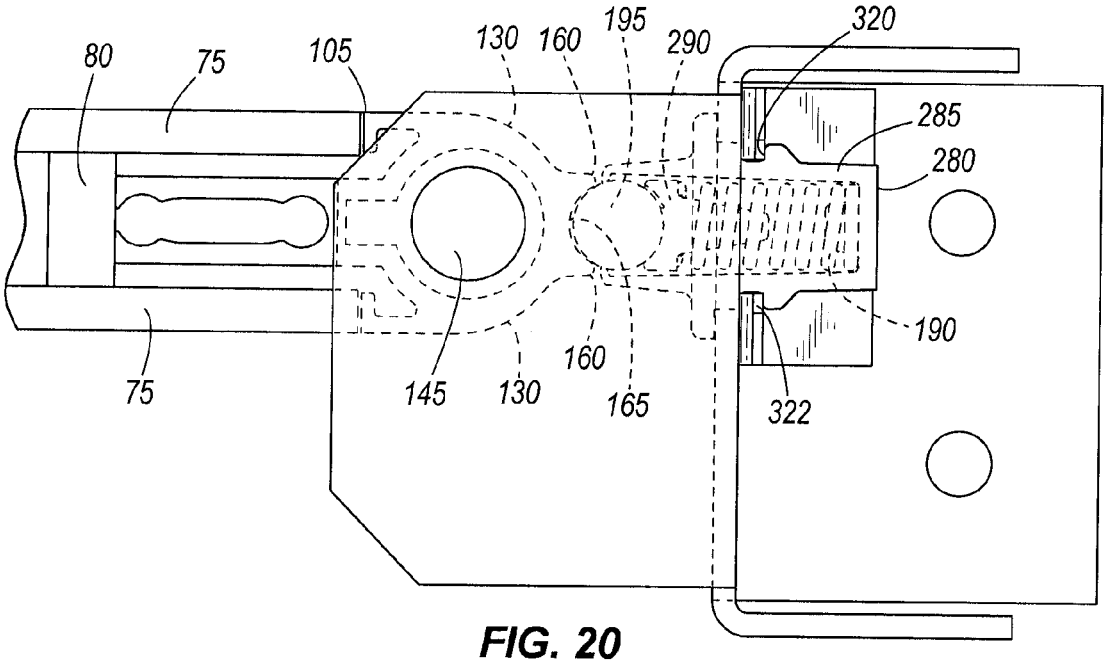
FIG. 20 is a top view of a portion of the merchandiser and the open door of FIG. 2 including the door hold open mechanism of FIG. 13.

As illustrated in FIGS. 7 and 20, when the door 60 reaches the open position, the springs 190 bias the pin 195 into engagement with the hinge channel 155. The pin 195 and the channel 155 cooperate with each other to resist movement of the door 60 toward the closed position. The ball-and-socket fit of the pin 195 and the channel 155 and engagement of the springs 190 with the pin 195 permit relative movement between the pin 195 and the channel 155 while adequately holding the pin 195 within the channel 155 absent an external closing force on the door 60. In particular, when the pin 195 is engaged with the hinge channel 155 due to the bias force of the springs 190, the cooperating engagement between the pin 195 and the hinge 105 must be adequate to resist movement of the door 60 toward the closed position due to the weight of the door 60 itself (i.e., absent a closing force exerted on the door 60). In other words, the spring rate of the springs 190, the distance that the pin 195 extends outward from the housing 175, 285, and the depth of the channel 155 are at least partly determined by the force that is necessary to hold the door 60 in the open position.

With reference to FIGS. 5-7, 19, and 20, the door hold open mechanism 170, 280 can be disengaged from the hinge 105 in response to a predetermined closing force that is exerted on the door 60. The predetermined closing force is sufficient to overcome the cooperating engagement of the pin 195 and the hinge channel 155 so that the pin 195 rolls or rotates out of engagement with the hinge 105 in response to the predetermined force. Specifically, when the predetermined closing force is first applied to the door 60, the pin 195 rolls or rotates along the curved surface 165 and is moved in the second direction against the bias of the springs 190 by one of the ridges 160. As the door 60 continues toward the closed position, the pin 195 rolls over the ridge 160 such that the pin 195 is completely disengaged from the channel 155, thereby allowing the door 60 to continue pivoting toward the closed position. The pin 195 continues to roll or rotate along the outer surface 130 of the hinge as the door 60 moves to the closed position.

The spring-loaded door hold open mechanism 170, 280 disperses energy along the surface of the hinge 105 to hold the door 60 in the open position, and releases the door 60 from the open position in response to a predetermined closing force. The door hold open mechanism 170, 280 can be used for holding the door 60 open for a period of time without user-operable door 60 catches to allow access to the product display area 40 (e.g., for stocking food product in the merchandiser). The door hold open mechanism 170, 280 subjects the door 60 to less stressful forces as compared with the forces associated with conventional door mechanisms. Also, the doors 60 and the associated door hold open mechanisms 170, 280 can be retrofit onto existing merchandisers by removing the case frame of the existing merchandiser and installing the case frame 50, the doors 60, and the door hold open mechanisms 170, 280.

Various features and advantages of the invention are set forth in the following claims.

The invention claimed is:

1. A merchandiser comprising:

a case defining a product display area for supporting and displaying food product, the case including a case frame having at least one mullion defining an opening into the product display area;

a door positioned over the opening and pivotably coupled to the case frame for movement between a closed position and an open position; and a door hold open mechanism attached to either the mullion or the door, the other of the mullion and the door defining a channel, the door hold open mechanism including an engagement member outwardly biased from the mullion or the door to which the door hold open mechanism is attached, the engagement member engageable with the other of the mullion and the door within the channel to hold the door in the open position to provide access to food product in the product display area;

wherein the door includes a hinge defining the channel at least partially along the length of the door, and the door hold open mechanism is attached to the mullion such that the engagement member is engaged with the door within the channel in response to movement of the door to the open position, and wherein the channel is integrally formed in the hinge.

2. The merchandiser of claim 1, wherein the engagement member is in contact with the hinge when the door is in the closed position.

3. The merchandiser of claim 1, wherein the channel is defined by opposed ridges and a curved surface extending between the opposed ridges such that when the door is held in the open position, the engagement member and the channel define a ball-and-socket fit.

4. The merchandiser of claim 3, wherein the door hold open mechanism is disengageable from the channel in response to a predetermined force applied to the door toward the closed position.

5. The merchandiser of claim 1, wherein the door hold open mechanism further includes a housing attached to the mullion, and wherein the engagement member is disposed in the housing and outwardly biased from the mullion to engage the door.

6. The merchandiser of claim 5, wherein the door hold open mechanism further includes a spring disposed in the housing and a plunger disposed in the housing and engaged with the spring, wherein the engagement member is partially nested within the housing and supported by the plunger, and wherein the engagement member is biased outward from the housing by the spring and the plunger.

7. The merchandiser of claim 6, wherein the engagement member includes an elongated, cylindrical roller.

8. The merchandiser of claim 1, wherein the engagement member is engaged with the channel when the door is angularly spaced approximately 90 degrees from the closed position.

9. The merchandiser of claim 1, wherein the door is a frameless door.

10. The merchandiser of claim 1, wherein the door hold open mechanism holds the door in the open position without a manually operated catch.

11. The merchandiser of claim 1, wherein the channel is disposed along an edge of the door.

12. The merchandiser of claim 11, wherein the hinge supports a pivot about which the door moves between the open and closed positions, and wherein the pivot is separate from the channel.

13. The merchandiser of claim 12, wherein the hinge separates the pivot from the engagement member.

14. A merchandiser comprising:

a case defining a product display area for supporting and displaying food product, the case including a case frame having at least one mullion defining an opening into the product display area;

a door positioned over the opening and pivotably coupled to the case frame for movement between a closed position and an open position, the door including a hinge defining a channel at least partially along the length of the door, the channel along an edge of the door; and a door hold open mechanism attached to the mullion and including an engagement member outwardly biased from the mullion, the engagement member engageable with the door within the channel to hold the door in the open position to provide across to food product in the product display area, and the engagement member disengageable from the door in response to a predetermined force applied to the door toward the closed position, the engagement member engaged with the door within the channel in response to movement of the door to the open position, wherein the hinge supports a pivot about which the door moves between the open and closed positions, and wherein the pivot is separate from the channel.

15. The merchandiser of claim 14, wherein the engagement member is in contact with the hinge when the door is in the closed position.

16. The merchandiser of claim 14, wherein the channel is defined by opposed ridges and a curved surface extending between the opposed ridges such that when the door is held in the open position, the engagement member and the channel define a ball-and-socket fit.

17. The merchandiser of claim 14, wherein the door hold open mechanism further includes a housing attached to the mullion, and wherein the engagement member is disposed in the housing and outwardly biased from the mullion to engage the door.

18. The merchandiser of claim 17, wherein the door hold open mechanism further includes a spring disposed in the housing to bias the engagement member outward and a plunger disposed in the housing and engaged with the spring, wherein the engagement member includes and elongated roller that is partially nested within the housing and supported by the plunger, and wherein the elongated roller is biased outward from the housing by the spring and the plunger.

19. The merchandiser of claim 14, wherein the engagement member is engaged with the channel when the door is angularly spaced approximately 90 degrees from the closed position.

20. The merchandiser of claim 14, wherein the door hold open mechanism holds the door in the open position without a manually operated catch in the absence of the predetermined force.

21. A merchandiser comprising:

a case defining a product display area for supporting and displaying food product, the case including a case frame having at least one mullion defining an opening into the product display area;

a door positioned over the opening and pivotably coupled to the case frame for movement between a closed position and an open position, the door including a hinge defining a channel at least partially along the length of the door, the channel disposed along an edge of the door; and a door hold open mechanism including a housing attached to the mullion, and a spring-loaded elongated pin outwardly biased from the housing and engageable with the door within the channel to hold the door in the open position to provide access to food product in the product display area;

wherein the hinge supports a pivot about which the door moves between the open and closed positions, and wherein the pivot is separate from the channel.

22. The merchandiser of claim 21, wherein the elongated pin is engaged with the door within the channel in response to movement of the door to the open position.

23. The merchandiser of claim 22, wherein the elongated pin is disengageable from the channel in response to a predetermined force applied to the door toward the closed position.

24. The merchandiser of claim 22, wherein the door hold open mechanism further includes a plunger disposed in the housing and supporting the elongated pin so that the pin can rotate relative to the housing and the plunger, and wherein the elongated pin is partially nested within the housing on the plunger.

* * * * *

UNITED STATES PATENT AND TRADEMARK OFFICE

CERTIFICATE OF CORRECTION

PATENT NO. : 8,517,477 B2
APPLICATION NO. : 12/777077
DATED : August 27, 2013
INVENTOR(S) : David W. Dickey et al.

It is certified that error appears in the above-identified patent and that said Letters Patent is hereby corrected as shown below:

In the Claims

Column 9, claim 14, line 55: replace the word "across" with the word --access--

Signed and Sealed this
Nineteenth Day of November, 2013

Teresa Stanek Rea
*Deputy Director of the United States Patent and Trademark Office*